US005549070A

United States Patent [19]

Cruchelow et al.

[11] Patent Number: 5,549,070

[45] Date of Patent: Aug. 27, 1996

[54] IN-WATER DRY DOCK SYSTEM

[76] Inventors: Albert Cruchelow, 23103 Bayleaf, Spring, Tex. 77373; Rodney H. Masters, 15730 Sellers Rd., Houston, Tex. 77060

[21] Appl. No.: 294,253

[22] Filed: Aug. 23, 1994

[51] Int. Cl.[6] ..... B63B 35/44

[52] U.S. Cl. ..... 114/263; 114/52

[58] Field of Search ..... 114/44–50, 52, 114/53, 263

[56] References Cited

U.S. PATENT DOCUMENTS 2,768,599 10/1956 Harris ..... 114/45
3,133,518 9/1961 Burnett .
3,976,022 8/1976 Lapeyre ..... 114/45
4,510,877 4/1985 Bloxham .
4,615,289 10/1986 Bloxham .
5,138,963 8/1992 Eichert .
5,140,922 8/1992 Bowman et al. ..... 114/45

*Primary Examiner*—Jesus D. Sotelo
*Attorney, Agent, or Firm*—Gunn & Associates, P.C.

[57] ABSTRACT

The present invention provides a simple system for in-water dry docking pleasure boats using existing boat slips. The system includes a dry-dock basin having a pair of ballast tanks mounted below the bottom surface of the basin. The basin is submerged using guide pipes below the boat slip where the boat is typically stored.

19 Claims, 9 Drawing Sheets

IN-WATER DRY DOCK SYSTEM

FIELD OF THE INVENTION

The present invention relates generally to the field of dry docks for storing watercraft or for use in performing maintenance and repairs on pleasure craft and other small boats and, more particularly, to a method and apparatus for dry docking boats using existing boat slips typically found in marinas.

BACKGROUND OF THE INVENTION

A boat hull requires periodic preventive and corrective maintenance. For example, maintenance is required on the submerged portion of a hull to remove accumulated algae, organisms, and general dirt and extraneous matter. The portion of a hull above the waterline is subject to other kinds of deterioration during normal operation of the craft, especially in a salt water environment, and this upper portion of a hull also requires occasional maintenance.

An owner of a pleasure craft may rent or own a boat slip in which to store his boat between outings. He may also own or have access to a hoisting assembly which typically is made of a hoist, cables, and slings to lift his boat out of the water for maintenance and repairs or simply to store the boat. By storing the boat out of the water, not only is the boat more easily maintained, it is also subjected to less attack from the elements and therefore requires less maintenance.

Larger boats, however, are generally more difficult to lift out of the water. To avoid the difficulty and expense (and possible damage to their boats) in routinely removing their boats from the water between outings, many owners of boats longer than 35 feet leave their boats in the water and periodically dry dock their boats at a commercial facility for periodic repair, painting, and other maintenance.

Commercial dry dock facilities are commonly of the submersible type. To dry dock a boat, the operator of the facility uses a relatively complex apparatus to submerge the dry dock, the craft is placed in position under its own power or by towing, and the submersible dry dock is lifted to lift the craft out of the water. Most submersible dry docks include various mechanisms such as doors, hydraulic or pneumatic cylinders, and other mechanisms. In addition to being expensive, such dry docks are subject to breakdown like any complex mechanical device.

Consequently, there remains a need for a simple, affordable, dry dock apparatus that will allow the owners of relatively shallow-draft pleasure craft to reduce their maintenance costs, perform needed maintenance, and generally secure their boats on a routine basis without significant structural modifications to existing storage facilities such as marinas.

The present invention solves these and other drawbacks in the prior art. This simplified dry docking system of the present invention is intended to be used at the boat owner's boat stall or slip. It can be installed into an existing structure with little or no structural modifications to the dock or overhead support structure. Further, no overhead structure is required in the use or emplementation of the present invention as in known dry docks. Since the dry dock system and method of the present invention is simple and compact, it is relatively inexpensive and places dry docking capabilities into the hands of the average boating enthusiast.

SUMMARY OF THE INVENTION

The present invention is a simplified system for in-water dry docking pleasure boats using existing boat slips. It is particularly useful for pleasure boats 35 feet or more in length but is equally usable for smaller boats, including outboard and inboard power boats and sailboats with solid keels. The system includes a dry-dock basin having a pair or sets of ballast tanks mounted below the bottom surface of the basin. The basin is raised and lowered along guide pipes alongside and extending below the boat slip where the boat is typically stored.

While this system is suitable for any size boat, it is particularly suitable for larger boats which are difficult to hoist out of the water, typically greater than 35 feet in overall length. When the boat is positioned in the boat slip and the dry dock system is submerged and resting on the mudline, the tanks of the dry dock system are totally de-ballasted so that the basin rises up to engage the boat. A plurality of anti-fouling pads engage the bottom of the boat and hold it within the basin of the dry dock. One feature of this invention is that the ballast tanks are not sized to lift the boat out of the water. They are sized with enough buoyancy capacity to allow the basin of the dry dock to rise in the water to such a point that contact is made with the bottom of the boat positioned in the slip. The basin is designed such that, when this contact is made, the sides of the dry dock basin are above water. The water within the basin is then pumped out and the boat is now totally dry docked, using the dry dock as the flotation medium. Thus, this apparatus provides a simple solution for private boat owners to dry dock their boats on a routine basis.

The present invention is easily adaptable to mounting to a solid pier. Accommodation may also be made to the use of fresh water in the ballast tanks, in areas where ambient water may foul the interior of the ballast tanks. The structure of the present invention may also be adapted for the use of sailboats with fixed keels.

These and other objects and features of the present invention will be immediately apparent to those of skill in the art as they read the following detailed description along with the drawing figures.

DETAILED DESCRIPTION OF A PREFERRED EMBODIMENT

The present invention is broadly applicable to salt water and fresh clocking needs; however, the preferred embodiment envisions using dock slips typically found in marinas and other storage facilities for pleasure craft.

Figure 1:
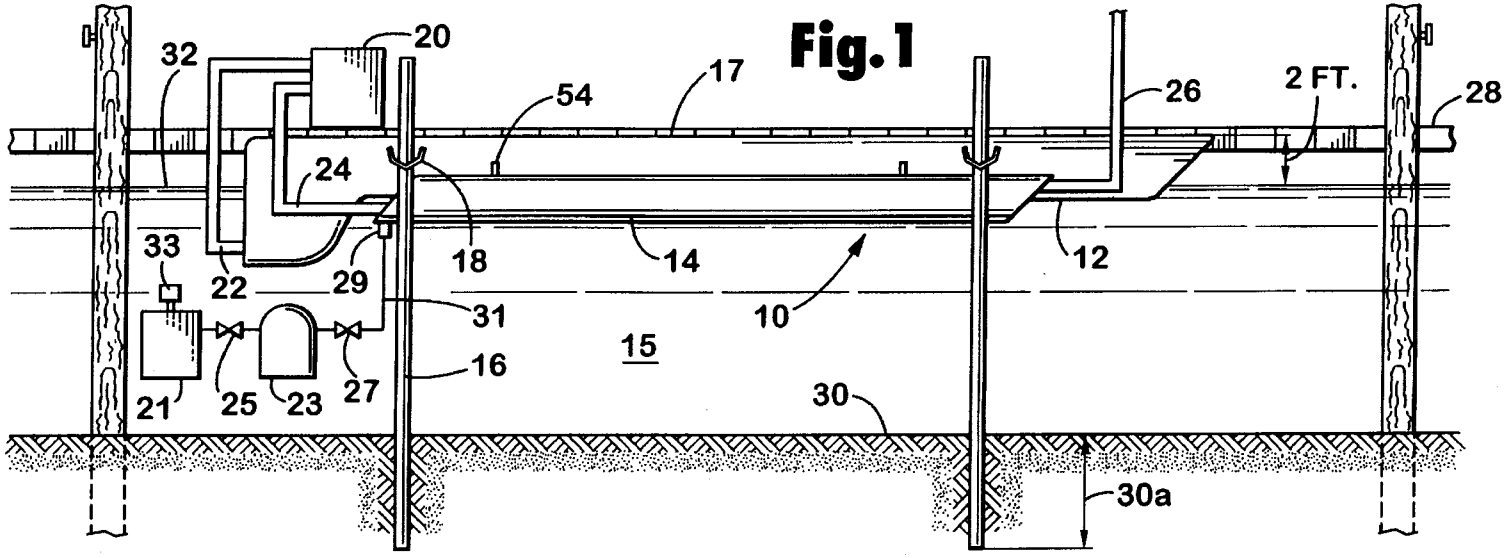
FIG. 1 is a side view of the dry dock system in a floating empty condition.
Figure 13:
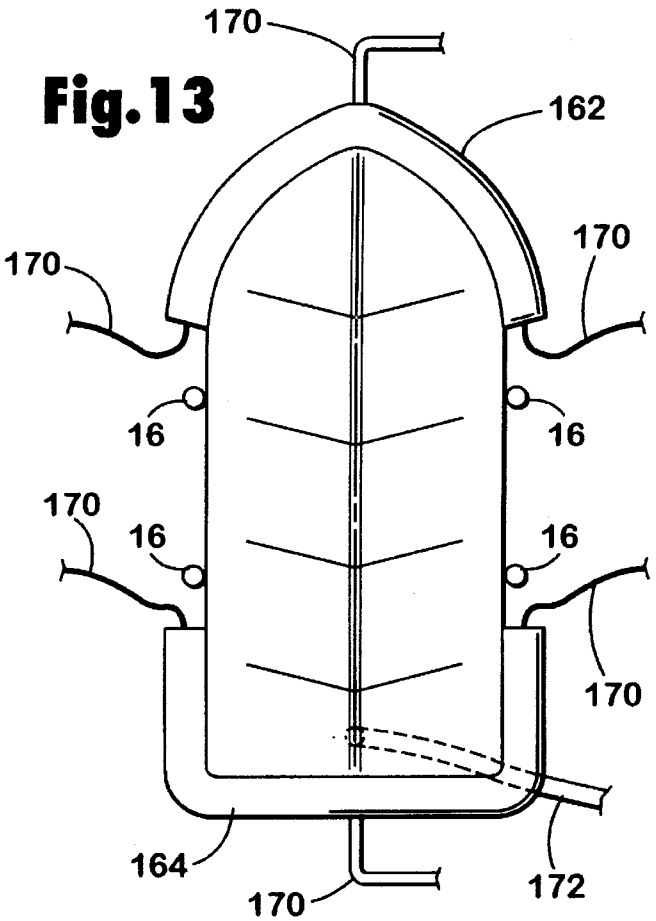
FIG. 13 is a plan view of an embodiment of the present invention to show a single forward ballast tank and a single after ballast tank.
Figure 10:
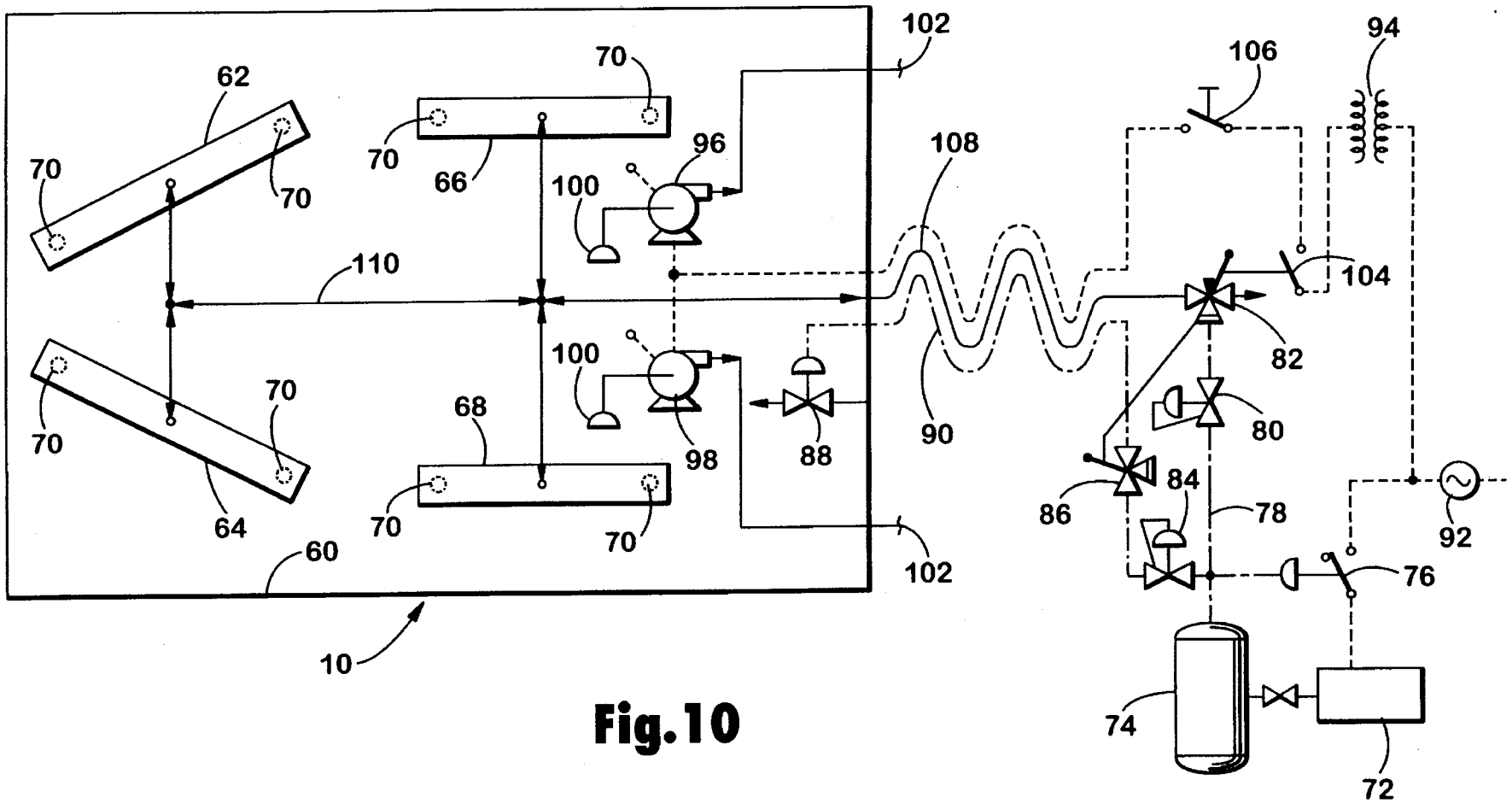
FIG. 10 is a schematic diagram of the air and water flow systems for operation of the present invention.
Figure 11:
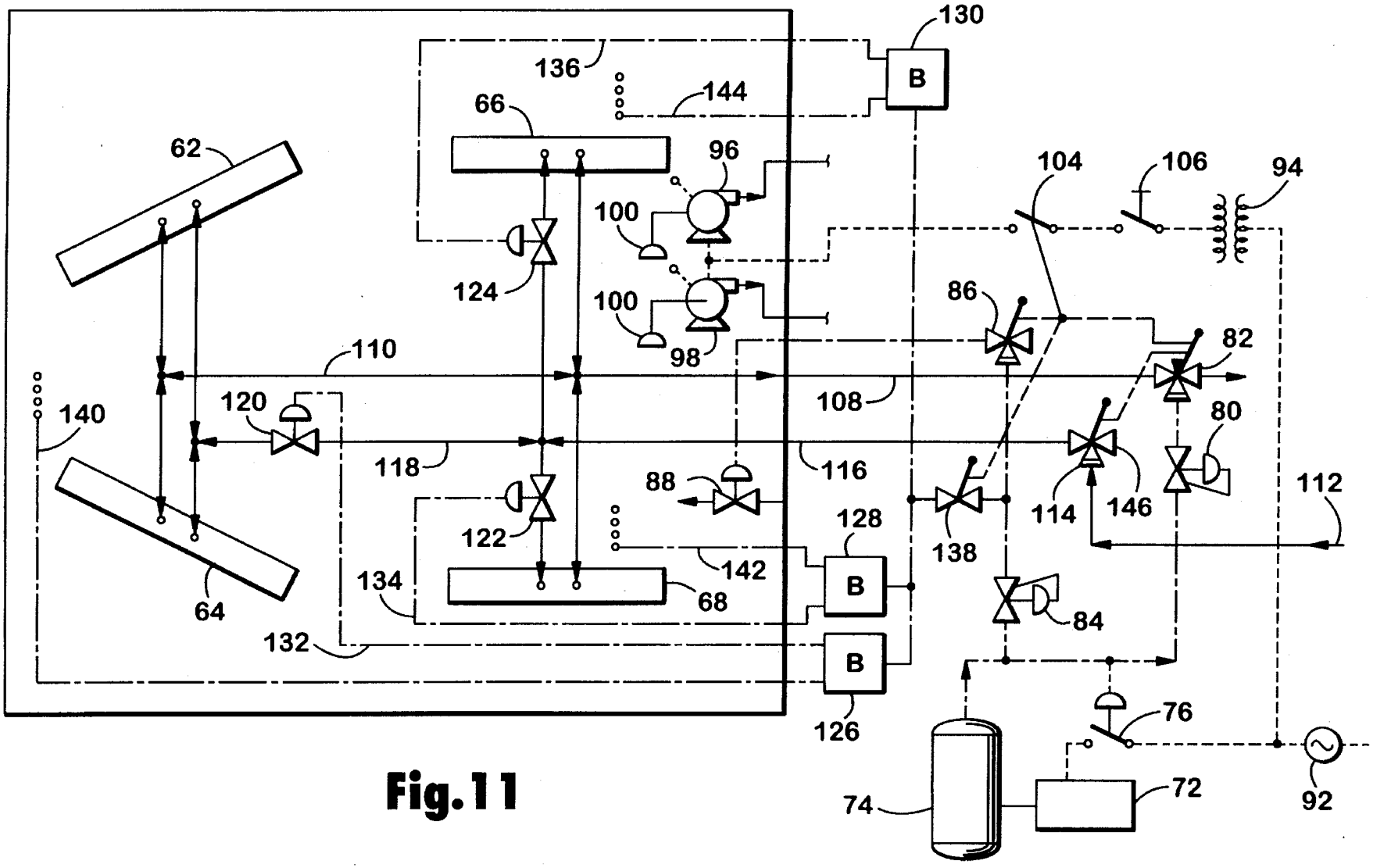
FIG. 11 is a schematic diagram of the air and water flow systems of the present invention that includes fresh water ballasting.

As shown in FIG. 1, a dry dock system 10 includes a unitary basin 12, a ballast tank 14 on each side of the basin 12, several guide pins 16 around the periphery of the basin 12, and several guide brackets 18. Those of skill in the art will recognize that the ballast tanks 14 may be provided with counter-flooding channels so that providing ballast to one tank 14 fills both tanks equally. While the ballast tanks in FIG. 1 are shown as port and starboard tanks, the ballasting system may include a forward tank 162 and an after tank 164, as shown in FIG. 13. Preferably, the ballasting system includes forward and after, port and starboard tanks 62, 64, 66, and 68, as shown in FIGS. 10 and 11, all described below in greater detail.

For ballasting and de-ballasting the dry dock system, a water control sub-system comprises a pump 20, a basin pipeline 22, a ballast pipeline 24 and a ballast vent line 26. The apparatus may also include a pneumatic control sub-system to assist in de-ballasting the dry dock system. The pneumatic sub-system comprises a source of pressurized air, such as for example an air compressor 21, an air receiver 23, associated valves 25 and 27, a quick-disconnect 29, and air lines 31. The pneumatic sub-system further comprises a switch means 33 to cycle the air compressor or pump to maintain the pressure in the receiver. The receiver may be omitted and the compressor coupled directly to the basin for pressure control. Further, the pneumatic sub-system is shown schematically in FIG. 1 and may be located anywhere convenient to the system.

For initial installation of the dry dock system 10, the basin 12 and associated apparatus is floated into a dock slip 28 in a typical marina and positioned in an appropriate location, as shown in FIG. 1. While the basin 12 is held in that position, the guide pins 16 are driven through the guide brackets 18 into the bottom 30 below a body of water, such as a mud line 30. Alternatively, the guide pins 16 can be fixedly attached to the dock slip 28. A depth 30*a* of the guide pins 16 into the bottom 30 may vary according to the specific application of the present invention and is field determined.

The pump 20 is located in a convenient location, whether on the basin 12, pier-side, or placed in a remote location. The ballast pipeline 24 and the basin pipeline 22 are preferably made of flexible hose and attached to the pump 20 with sufficient length to allow the dry dock system 10 to be lowered to the bottom 30. The ballast vent line 26 is secured to the ballast tanks 14 with sufficient flexible length to allow the dry dock system to be lowered to the bottom 30.

To lower the dry dock system for entry of a boat into the system, water is first pumped or flooded into the basin 12 by the pump 20 or from the water 15 surrounding the system. This lowers the system until an upper edge 17 of the basin is just above water, for example 1–2" above water. Next, water is pumped into each ballast tank or the ballast tank system 14 by the pump 20. Alternatively, the ballast tanks 14 may be filled with water by flooding. The ballast tanks are filled equally so that the basin remains level. The reduced buoyancy of the ballast tanks 14 lowers the basin 12 and determines the overall buoyancy of the system. Therefore, control of the sinking of the dry dock is provided by the ballast tanks. It is important to note that flooding the ballast tanks alone or the basin alone does not cause the system to sink to the mudline.

Figure 2:
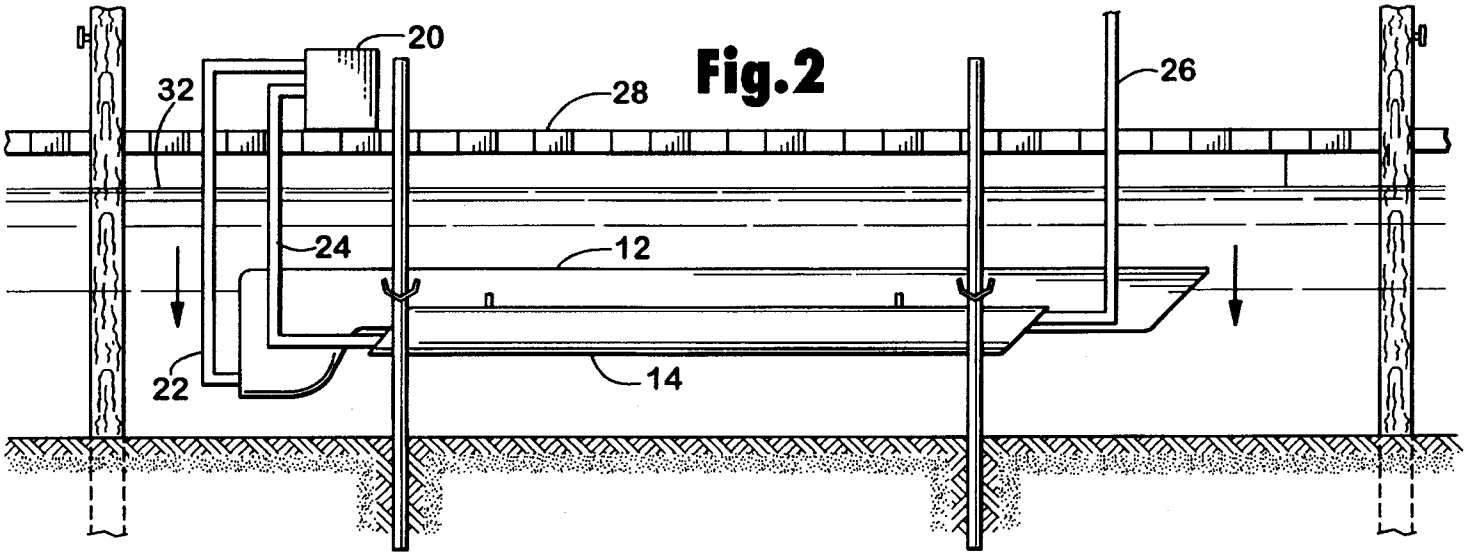
FIG. 2 is a side view of the dry dock system in an intermediate descending position.
Figure 3:
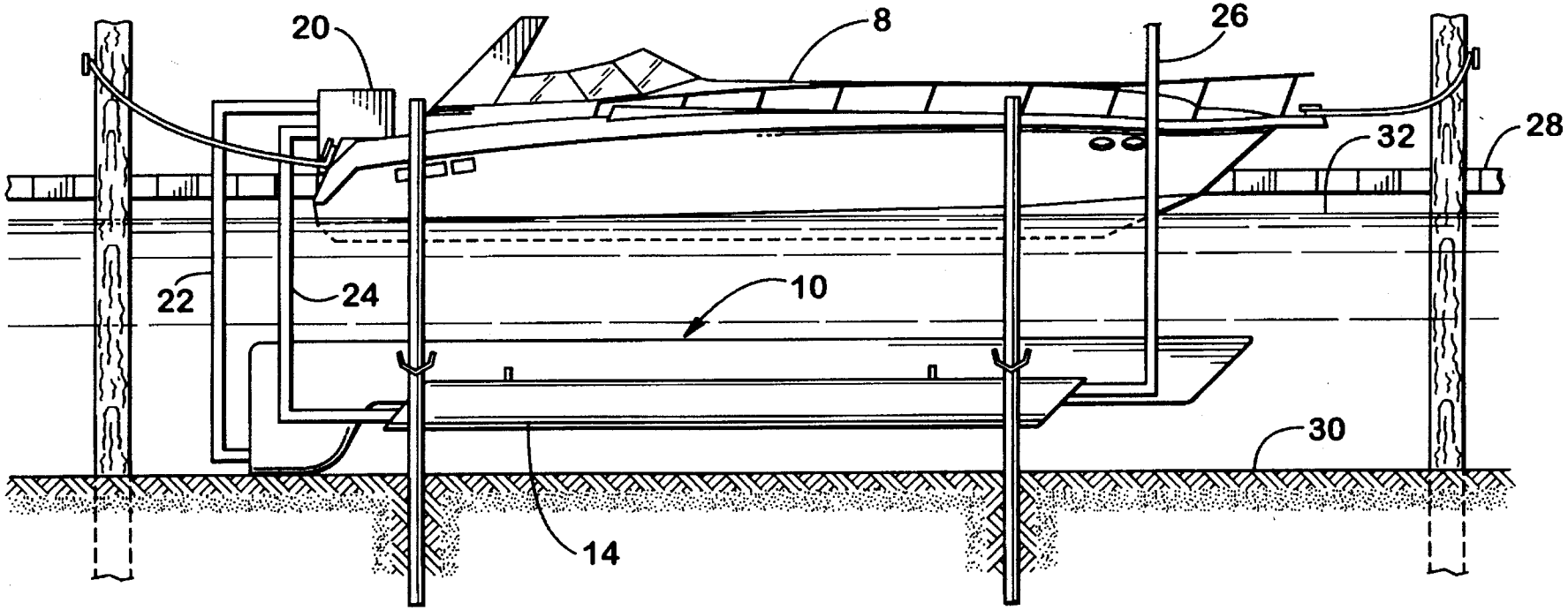
FIG. 3 is a side view of the dry docking system in a resting submerged position with a boat floating in the dock slip.

FIG. 2 depicts the dry dock system in a partially submerged condition. At this state, the tanks are totally full and the basin is full. This action completely submerges the dry dock system 10 until it comes to rest typically on the bottom 30, as shown in FIG. 3. However, the system need not be submerged all of the way to the bottom, so long as it is lowered enough to allow a boat to enter the submerged dry dock. A boat 8 is then pulled into the dock slip 28 and secured, as shown in FIG. 3.

Figure 4:
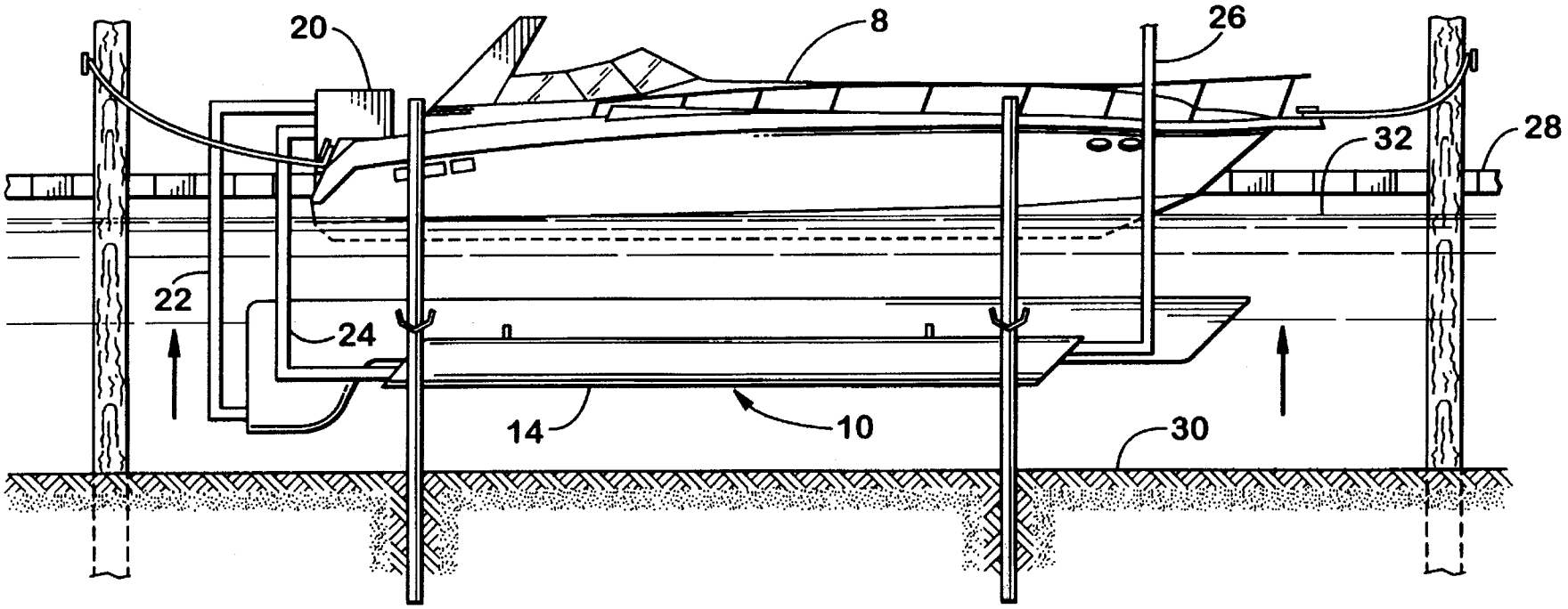
FIG. 4 is a side view of the dry dock system in an intermediate rising position.
Figure 5:
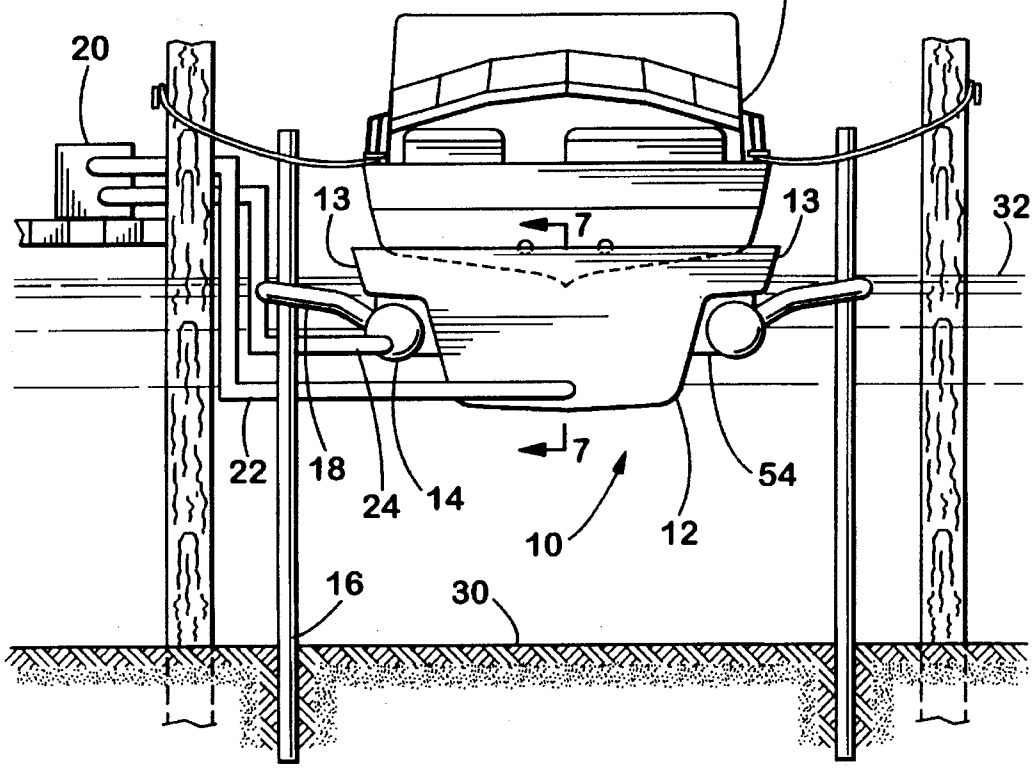
FIG. 5 is an end view of the dry docking system at a point when the hull has initially contacted the bottom of the boat, partially raised, and having penetrated the water level.
Figure 6:
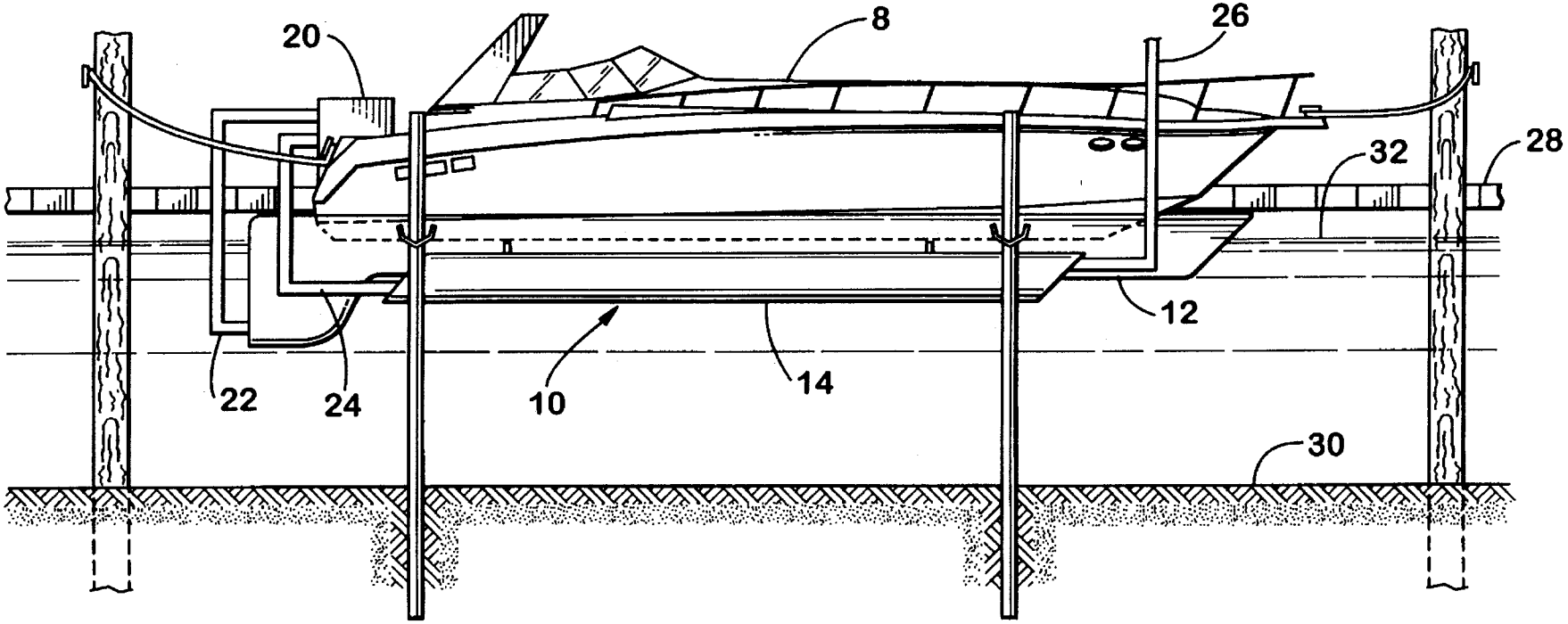
FIG. 6 is a side view of the dry docking system fully raised and supporting the boat.

To begin raising the dry dock system 10, water is pumped out of the ballast tanks 14, as shown in FIG. 4. Continuing to pump the water from the ballast tanks 14 raises the dry dock system 10 until rubberized boat supporting pads 56 (see FIG. 9) make contact with the bottom of the boat 8, at which point the upper edges 13 sides of the basin 12 penetrate the waterline 32, as shown in FIG. 5. To complete the dry docking process, the water remaining in the basin 12 is pumped out by the pump 20 through the basin pipeline 22, leaving the boat 8 in the dry dock position with the basin 12 and ballast tank 14 pumped sufficiently empty of water to enable the boat to be dry docked, as shown in FIG. 6. The boat remains in this position until the use of the boat is needed or maintenance is complete. The process is then reversed to put the boat back in the water.

This system permits storage of a boat in a relatively benign environment. Because of the simplicity of the operation and the relatively small size of the present invention, this dry dock can be used on a routine basis as opposed to the typical commercial dry docking systems found in repair facilities which require large structural lifting components and frames.

As shown in FIGS. 1 and 5, the ballast tanks 14 may be attached to the basin 12 by gussets 54. The diameter and length of a ballast tank system 14 in a preferred embodiment is determined by the submerged weight of the basin 12. The ballast tank 14 may be made from any appropriate weather and corrosion resistant material, such as polyvinyl chloride (PVC) pipe or fiberglass, either wound or layered. The guide pins 16 may be made from 4"–6" diameter plastic pipe such as PVC pipe or fiberglass, either wound or layered. The diameter of the guide pins is a function of the water depth. The ballast tanks 14 may be mounted on both sides of the basin 12 toward the bottom of basin 12 as shown in FIG. 5. Multiple tanks can be installed such as the two shown in FIG. 5 and can be connected in series by well known methods. Alternatively, they can be separated for independent operation and control, as described below in greater detail with regard to FIGS. 10 and 11.

Figure 7:
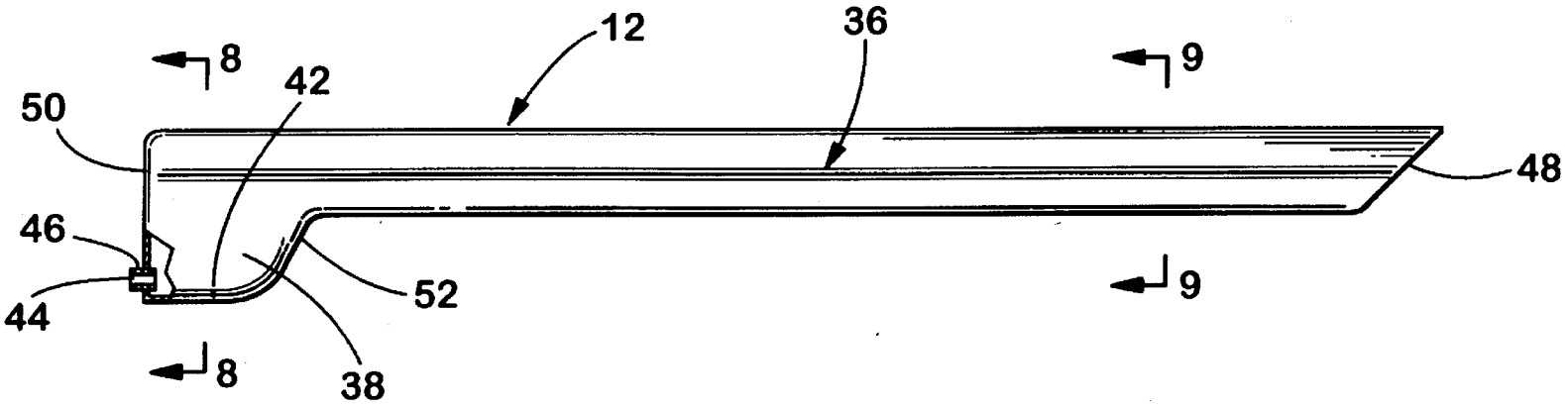
FIG. 7 is a longitudinal cross section of the basin of the dry dock system.
Figure 8:
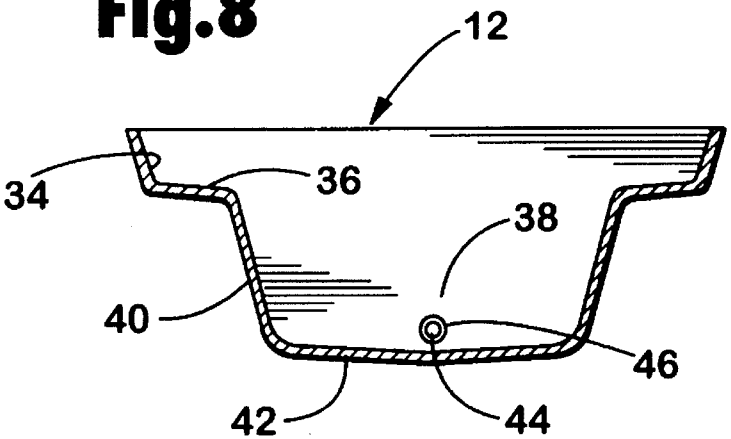
FIG. 8 is a transverse cross section across the bow of the basin of the dry docking system.

The basin 12 may be made of fiberglass material in a typical thickness of one-half inch. As shown in FIG. 7, the basic configuration of the basin 12 is defined by a bow 48, a stern 50, a bottom 36, and sides 34. FIG. 8 depicts a cross section of the stern portion of the basin as depicted in FIG. 7. The basin 12 also includes a lower cavity 38 which is formed by a front sloping surface 52, the stern 50, cavity sides 40, and a cavity bottom 42. A hole 44 in the stern 50 is formed by molding a coupling 46 into the stern 50. The cavity 38 provides clearance for outboard engines' drive shafts or propellers on the boat 8. The bottom 36 preferably slopes inwardly towards the longitudinal centerline of the basin 12. Likewise, the cavity bottom 42 preferably slopes inwardly towards the longitudinal center of cavity 38. The bottom 36 may also be shaped to slope toward the stern 50 like the cavity bottom 42 and the sloping surface 52. These slopes move the water draining from basin 12 toward stern 50 for pumping out the hole 44. Attached to the coupling 46 is the basin pipeline 22, as shown in FIG. 1. The pump 20 fills and drains the water from the basin 12 through the hole 44.

Figure 9:
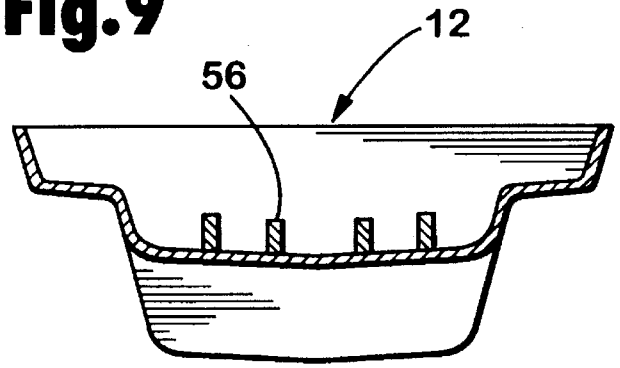
FIG. 9 is a transverse cross section of the basin of the dry docking system showing an alternative embodiment of supporting structures on the basin.

The basin 12, and specifically the bottom 36 in the cavity 38, may be contoured to fit the bottom of the boat 8. This contour allows a distributed force across the surface of the basin 12. Alternatively, a plurality of supporting and anti-fouling pads 56, as shown in FIG. 9, help support the bottom of the boat 8.

Referring now to FIG. 10, an alternative, preferred embodiment for ballasting and de-ballasting is depicted. FIG. 10 is intended to diagramatically depict various aspects of a preferred embodiment of the present invention and is not necessarily to scale. A hull limit 60 defines the maximum extent of the outside extremities of the dry dock system 10, particularly the basin. FIG. 10 also includes a plurality of ballast tanks 62, 64, 66, and 68, described in greater detail below with regarding to FIG. 12. Ballast tanks 62 and 64 are the forward ballast tanks and ballast tanks 66 and 68 are the after ballast tanks. Placing the ballast tanks separated fore and aft provides improved control of the horizontal aspect of the dry dock system as the basin is raised and lowered.

Each of the ballast tanks, 62, 64, 66, and 68 is provided with at least one bottom blow-hole 70, and preferably at least two such blow-holes. Each blow-hole is covered with a screen to keep the interior of the ballast tank relatively clean and to keep marine life out of the tanks. The blow-holes 70 are located on the bottom of the ballast tanks so that, when the ballast tanks have been filled with air, any additional air pumped into the tanks will be vented out the bottom. Further, when air is vented from the tanks, water is then permitted to flow into the bottom of the tanks.

The ballasting/de-ballasting system of FIG. 10 includes an air compressor 72. The air compressor 72 provides low-pressure air, perhaps at about 30–45 psig, to an air receiver 74, perhaps 1–3 cubic feet. Air pressure within the air receiver 74 is maintained by cycling the air compressor 72, which is controlled by a pressure switch 76.

The air receiver 74 delivers the low-pressure air to an air-feed line 78. The air feed line 78 includes a back pressure regulator 80 which is then coupled to a lever operated four-way operator control valve 82. The four positions on the control valve 82 are (1) raise the dry-dock; (2) pump out the basin; (3) flood the basin; and (4) sink the dry-dock. The air and water flow during these operations are described in further detail below.

Off the air feed line 78 is coupled a pressure reducing regulator 84 which is connected to a three-way control valve 86. The reducing regulator 84 reduces the air pressure to that necessary for the operation of a basin flood valve 88. The reduced pressure air from the control valve 86 is carried over a line of air signal tubing 90 to the actuator of the flood valve 88. Opening the flood valve 88 allows water in which the dry dock system is floating to flood the basin to the point where a craft within the dry dock system is disengaged from the dry dock and floating within the basin.

The system 10 of FIG. 10 further includes electrical circuitry to power and control of the various electrical components. A power source 92, preferably standard 120 Vac line current, powers the system. The ac power is provided to the compressor 72 via the pressure switch 76. A 120 Vac/24 Vdc transformer/rectifier 94 provides 24 volts dc power to a pair of bilge pumps 96 and 98, although only one bilge pump may be included in the system. Each of the bilge pumps is provided with a suction strainer and a level switch 100 for shutoff control as desired. As shown in FIG. 10, the bilge pumps take a suction on the water within the basin and pump this water over the side through discharge lines 102. To perform this pumping function, the four-way control valve 82 is placed in the position to de-water the basin, which shuts a series switch 104. Then, a manual (on/off) switch 106 is turned or pressed to the "ON" position to energize the bilge pumps 96 and 98. The basin de-watering operation is then stopped by the level switches 100, or by placing the switch 106 in the "OFF" position, or by repositioning the four-way control valve 82.

The four-way control valve 82 also provides the means to float the dry dock. Placing the valve 82 in the "Float Drydock" position ports air from the receiver 74 through an air line 108 into an air header 110, preferably of PVC pipe. The air header 110 delivers air to the ballast tanks 62, 64, 66, and 68 when the dry dock is to be floated and air is pumped to the tanks until air bleeds from the blow holes 70. To sink the dry dock, the header 110 vents air from the tanks over the air line and out the four-way valve 82.

To summarize, to use the system of FIG. 10 to drydock a boat, the system is initially sunk to a depth sufficient to permit a boat to be driven or floated over the dry dock, usually on the bottom in shallow water. This accomplished by flooding the basin and filling the ballast tanks, as described. With a boat then positioned over the dry dock, air is blown into the ballast tanks until air vents out the blow holes. The dry dock will rise due to its buoyancy until the upper edges of the basin break the surface and zero buoyancy is achieved. Then, the bilge pumps pump out the water in the basin until the boat is supported entirely by the dry dock in a dry condition. To launch the boat, the basin flood valve is opened and the basin is flooded until the boat is floating free of the dry dock. Finally, air is vented from the ballast tanks and the dry dock is sunk to a point where the boat can be floated clear of the dry dock.

FIG. 11 depicts a system which is useful in areas where it is undesirable to permit water from around, the dry dock (e.g., seawater) into the ballast tanks. Components common to the system of FIG. 10 are numbered with the same element numbers. The system of FIG. 11, however, includes an entirely new fresh water system. A fresh water supply 112, such a municipal water main, provides fresh water to a three-way ballast supply valve 114. The ballast supply valve 114 is linked to the four-way operator control valve 82. When the operator control valve 82 is placed in the "Sink Dry Dock" position, fresh water is ported to a water hose 116 to provide fresh water to a fresh water supply header 118. Water from the header 118 to the ballast tanks 62, 64, 66, and 68 is controlled by one or more ballast tank control valves 120, 122, and 124. While ballast fill control could be provided by one such control valve, it is preferred to have the ballast tank control valve 120 to deliver fresh water to the forward ballast tanks 62 and 64, the ballast tank control valve 122 to deliver fresh water to the after port ballast tank 68, and the ballast tank control valve 124 to deliver fresh water to the after starboard ballast tank 66, respectively.

Each of the ballast tank control valves is provided with a control signal from its own bubbler system 126, 128, or 130. This control signal is carried over a control line 132, 134, 136, respectively. Air supply for actuation of the ballast tank control valves comes from the pressurized air system via a supply valve 138 that is operatively linked to the operator control valve 82. Each bubbler system is also provided with a depth measurement element 140, 142, 144 to measure the dry dock float position and to control ballast tank flooding valves. In operation, the ballast tank control valves are full open when the dry dock is on the surface and they are 20% open when the bubbler systems sense a level of from 1 to 2 feet. The air supply valve 138 is shut, shutting of the bubbler systems, when air is vented into the ballast tanks to float the dry dock and valve 138 is open when the ballast tanks are flooded with fresh water. When the dry dock is to be floated, fresh water from the ballast tanks is blown out through a vent 146.

Figure 12:
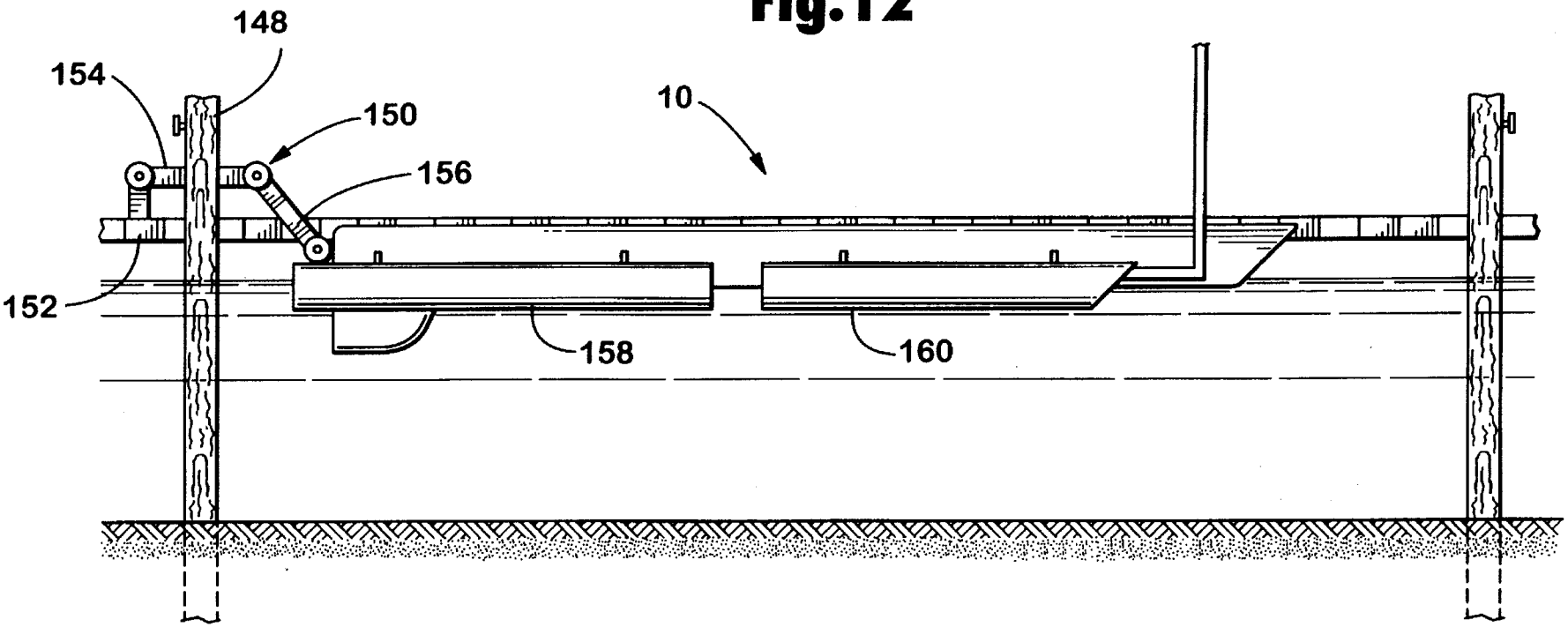
FIG. 12 is a side view of an embodiment of the present invention to show permanent mounting of the present invention to a solid pier.

Next, FIG. 12 illustrates an embodiment of the present invention that is particularly useful where the dry dock system can remain attached to a solid pier, such as a concrete pier 148. In this case, an articulated alignment system 150 is solidly mounted to a deck 152 and a plurality of articulated arms 154, 156 maintain the dry dock system 10 in horizontal relationship with the pier.

FIG. 12 also depicts the ballast tanks separated fore and aft for refined pitch control during all operations of the dry dock. Visible in FIG. 12 is a single after starboard tank 158 and a forward starboard tank 160. Alternatively, the ballasting system shown in FIG. 13 includes a single forward ballast tank 162 and a single after ballast tank 164. A plurality of supply/suction lines 170 are provided to accommodate any of the previously described ballasting techniques. The system also provides an access line 172 into the bottom of the basin to permit flooding or pumping of the basin.

Throughout the foregoing description, the basin and ballasting system have been described as separate components. However, for simplicity of construction, the ballasting system and the basin may be formed of a single component, with a portion of the whole comprising a hollow portion that performs the function of the ballast tank and an open-topped portion that performs the function of the previously described basin.

While the above embodiments are illustrative of the invention and have been described with particularity, it will be understood that variations and modifications will be apparent and can be readily made by those skilled in the art without departing from the spirit and scope of the invention. For example, those of skill in the art will immediately recognize that the structure of the present invention is easily adaptable to accommodate a sailboat with a fixed keel, and is fully within the scope and spirit of the present invention.

We claim:

1. A dry dock comprising:

(a) a floodable basin;

(b) a ballast tank coupled to the basin and hydraulically isolated from the basin;

(c) a water source coupled to the ballast tank to selectively admit water into the ballast tank;

(d) a vent from the ballast tank to allow water to be removed from the ballast tank;

(e) a guide means for fixing the spatial relationship between the dry dock system and a boat-slip and for guiding the dry dock system for vertical movement; and (f) means to pump water from the basin independent of the ballast tank.

2. The dry dock of claim 1 wherein the guide means comprises a plurality of guide pins slidably engaged with the basin through guide brackets.

3. The dry dock of claim 1 wherein the guide means comprises an articulated arm rotatably mounted to a pier adjacent the dry dock and coupled to the basin.

4. The dry dock of claim 1 further comprising a source of pressurized air coupled to the ballast tank to selectively force water from the ballast tank.

5. The dry dock of claim 1 wherein the basin comprises a one piece molded basin.

6. The dry dock of claim 5 wherein the basin is made of fiberglass.

7. The dry dock of claim 1 wherein the ballast tanks are made of PVC pipe.

8. The dry dock of claim 1 wherein the basin defines a forward end and an after end and wherein the ballast tank comprises a forward tank element adjacent the forward end of the basin and an after tank element adjacent the after end of the basin.

9. The dry dock of claim 1 wherein basin defines a port side and a starboard side and the ballast tank comprises a port ballast tank element adjacent the port side of the basin and a starboard ballast tank element adjacent the starboard side of the basin.

10. A method for storing boats out of water comprising the steps of:

(a) positioning a boat over a submerged dry dock having a basin with an upper rim and a ballast tank filled with water, the ballast tank hydraulically isolated from the basin;

(b) pumping water from the ballast tank;

(c) raising the dry dock until the upper rim broaches the surface of the water in which the dry dock is submerged;

(d) engaging the boat's bottom exterior surface with the dry dock; and (e) pumping water out of the basin independent of the ballast tank.

11. The method of claim 10 further comprising the step of positioning a guide means adjacent the basin to control the horizontal position of the dry dock as it is moved in a vertical direction.

12. A dry dock comprising:

(a) a hollow dry dock body, the body defining a basin and a ballast tank hydraulically isolated from the basin;

(b) a guide means for fixing the spatial relationship between the dry docking system and a boat-slip;

(c) a source of compressed air coupled to the basin;

(d) a means for transferring air from the air source to the basin; and (e) vent means for evacuating the air from the basin.

13. The apparatus of claim 12 wherein the basin comprises a one piece molded basin.

14. The apparatus of claim 12 wherein the basin is made of fiberglass.

15. The apparatus of claim 12 wherein the air source includes a switching means for activating an air pump to maintain air pressure in the basin.

16. A method of storing boats out of water comprising the steps of:

(a) positioning a boat over a submerged, hollow dry dock, the dry dock defining a ballast tank hydraulically isolated from a basin;

(b) pumping air into the ballast tank;

(c) raising the dry dock to engage the boat's exterior surface;

(d) continuing to pump air into the until the dry dock is raised above a water level; and (e) thereafter pumping water from the basin independently of the ballast tank.

17. The method of claim 16 comprising the additional step of positioning a guide means to control spatial relationship of the dry dock in its raising and lowering.

18. A dry dock comprising:

(a) a floodable basin defining a forward end, an after end, a port side, and a starboard side, each said end and each said side having an upper rim;

(b) a ballast tank adjacent the forward end and the port side of the basin;

(c) a ballast tank adjacent the forward end and the starboard side of the basin;

(d) a ballast tank adjacent the after end and the port side of the basin;

(e) a ballast tank adjacent the after end and the starboard side of the basin;

(f) a blow hole in the bottom of each ballast tank to selectively allow water to flood into each ballast tank;

(g) a source of compressed air coupled to each ballast tank to selectively force water from each ballast tank;

(h) a valve connected to the basin to conduct water into the basin; and (i) a pump fluidly coupled to the basin to take a suction from the basin and pump water out of the basin;

wherein each of said ballast tanks is hydraulically isolated from the basin.

19. The dry dock of claim 18 further comprising a source of fresh water coupled to each said ballast tank to flood each said ballast tank.

* * * * *